US007771907B2

(12) United States Patent
Wu et al.

(10) Patent No.: US 7,771,907 B2
(45) Date of Patent: Aug. 10, 2010

(54) OVERCOATED PHOTOCONDUCTORS

(75) Inventors: Jin Wu, Webster, NY (US); John F Yanus, Webster, NY (US); Kenny-Tuan Dinh, Webster, NY (US); Daniel V Levy, Philadelphia, PA (US)

(73) Assignee: Xerox Corporation, Norwalk, CT (US)

( * ) Notice: Subject to any disclaimer, the term of this patent is extended or adjusted under 35 U.S.C. 154(b) by 431 days.

(21) Appl. No.: 12/033,276

(22) Filed: Feb. 19, 2008

(65) Prior Publication Data

US 2009/0208856 A1 Aug. 20, 2009

(51) Int. Cl.
*G03G 5/14* (2006.01)

(52) U.S. Cl. ..... 430/57.3; 430/66

(58) Field of Classification Search ..... 430/57.3, 430/66

See application file for complete search history.

(56) References Cited

U.S. PATENT DOCUMENTS 4,265,990 A 5/1981 Stolka et al.
4,298,697 A 11/1981 Baczek et al.
4,338,390 A 7/1982 Lu
4,560,635 A 12/1985 Hoffend et al.
4,654,284 A 3/1987 Yu et al.
5,021,309 A 6/1991 Yu
5,069,993 A 12/1991 Robinette et al.
5,096,795 A 3/1992 Yu
5,204,201 A * 4/1993 Schank et al. ..... 430/58.8
5,919,590 A 7/1999 Yu et al.
5,935,748 A 8/1999 Yu et al.
6,303,254 B1 10/2001 Yu et al.
6,528,226 B1 3/2003 Yu et al.
6,562,531 B2 5/2003 Niimi
6,899,983 B2 * 5/2005 Tamoto et al. ..... 430/58.2
6,939,652 B2 9/2005 Yu

OTHER PUBLICATIONS

Jin Wu et al., U.S. Application No. (not yet assigned) on Anticurl Backside Costing (ACBC) Photoconductors, filed concurrently herewith, Feb. 19, 2008.
Jin Wu et al., U.S. Application No. (not yet assigned) on Overcoat Containing Fluorinated Poly(Oxetane) Photoconductors, filed concurrently herewith, Feb. 19, 2008.
Jin Wu et al., U.S. Application No. (not yet assigned) on Backing Layer Containing Photoconductor, filed concurrently herewith, Feb. 19, 2008.
John F. Yanus et al., U.S. Appl. No. 11/593,875 on Silanol Containing Overcoated Photoconductors, filed Nov. 7, 2006.
John F. Yanus et al., U.S. Appl. No. 11/593,657 on Overcoated Photoconductors with Thiophosphate Containing Charge Transport Layers, filed Nov. 7, 2006.
John F. Yanus et al., U.S. Appl. No. 11/593,656 on Silanol Containing Charge Transport Overcoated Photoconductors, filed Nov. 7, 2006.
John F. Yanus et al., U.S. Appl. No. 11/593,662 on Overcoated Photoconductors with Thiophosphate Containing Photogenerating Layer, filed Nov. 7, 2006.
Jin Wu et al., U.S. Appl. No. 11/728,006 on Photoconductors Containing Fluorinated Components, filed Mar. 23, 2007.
Jin Wu et al., U.S. Appl. No. 11/728,013 on Photoconductor Fluorinated Charge Transport Layers, filed Mar. 23, 2007.
Jin Wu et al., U.S. Appl. No. 11/728,007 on Overcoated Photoconductors Containing Fluorinated Components, filed Mar. 23, 2007.
Jin Wu et al., U.S. Application No. 11/961,549 on Photoconductors Containing Ketal Overcoats, filed Dec. 20, 2007.

* cited by examiner

*Primary Examiner*—John L Goodrow
(74) *Attorney, Agent, or Firm*—E. O. Palazzo

(57) ABSTRACT

A photoconductor containing an optional supporting substrate, a photogenerating layer, a charge transport layer, and a top overcoating layer in contact with and contiguous to the charge transport layer.

24 Claims, No Drawings

OVERCOATED PHOTOCONDUCTORS

CROSS REFERENCE TO RELATED APPLICATIONS

U.S. application Ser. No. 12/033,247, U.S.Publication 20090208859, filed Feb. 19, 2008, filed concurrently herewith by Jin Wu et al., entitled Anticurl Backside Coating (ACBC) Photoconductors, the disclosure of which is totally incorporated herein by reference, discloses a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a fluorinated poly(oxetane) polymer.

U.S. application Ser. No. 12/033,267, U.S.Publication 20090208857, filed Feb. 19, 2008, filed concurrently herewith by Jin Wu et al., entitled Overcoat Containing Fluorinated Poly(Oxetane) Photoconductors, the disclosure of which is totally incorporated herein by reference, discloses a photoconductor comprising a supporting substrate, a photogenerating layer, and at least one charge transport layer comprised of at least one charge transport component, and in contact with the charge transport layer an overcoat layer comprised of a polymer, an optional charge transport component, and a fluorinated poly(oxetane) polymer.

U.S. application Ser. No. 12/033,279, U.S.Publication 20090208858, filed Feb. 19, 2008, filed concurrently herewith by Jin Wu et al., entitled Backing Layer Containing Photoconductor, the disclosure of which is totally incorporated herein by reference, a photoconductor comprising a substrate, an imaging layer thereon, and a backing layer located on a side of the substrate opposite the imaging layer wherein the outermost layer of the backing layer adjacent to the substrate is comprised of a self crosslinked acrylic resin and a crosslinkable siloxane component.

The following related photoconductor applications are also being recited. The disclosures of each of the following copending applications are totally incorporated herein by reference.

U.S. application Ser. No. 11/593,875, filed Nov. 7, 2006 on Silanol Containing Overcoated Photoconductors, by John F. Yanus et al., which discloses an imaging member comprising an optional supporting substrate, a silanol containing photogenerating layer, and at least one charge transport layer comprised of at least one charge transport component and an overcoating layer in contact with and contiguous to the charge transport, and which overcoating is comprised of an acrylated polyol, a polyalkylene glycol, a crosslinking agent, and a charge transport component.

U.S. application Ser. No. 11/593,657, filed Nov. 7, 2006 on Overcoated Photoconductors With Thiophosphate Containing Charge Transport Layers, which discloses, for example, an imaging member comprising an optional supporting substrate, a photogenerating layer, and at least one charge transport layer, and wherein at least one charge transport layer contains at least one charge transport component and at least one thiophosphate; and an overcoating layer in contact with and contiguous to the charge transport layer, and which overcoating is comprised of an acrylated polyol, a polyalkylene glycol, a crosslinking component, and a charge transport component.

U.S. application Ser. No. 11/593,656, filed Nov. 7, 2006 on Silanol Containing Charge Transport Overcoated Photoconductors, by John F. Yanus et al., which discloses an imaging member comprising an optional supporting substrate, a photogenerating layer, and at least one charge transport layer comprised of at least one charge transport component and at least one silanol; and an overcoating in contact with and contiguous to the charge transport layer, and which overcoating is comprised of an acrylated polyol, a polyalkylene glycol, a crosslinking component, and a charge transport component.

U.S. application Ser. No. 11/593,662, filed Nov. 7, 2006 on Overcoated Photoconductors with Thiophosphate Containing Photogenerating Layer, by John F. Yanus et al., which discloses an imaging member comprising an optional supporting substrate, a photogenerating layer, and at least one charge transport layer, and wherein the photogenerating layer contains at least one thiophosphate, and an overcoating layer in contact with and contiguous to the charge transport layer, and which overcoating is comprised of an acrylated polyol, a polyalkylene glycol, a crosslinking component, and a charge transport component.

U.S. application Ser. No. 11/728,006, filed Mar. 23, 2007 by Jin Wu et al. on Photoconductors Containing Fluorinated Components, discloses a photoconductor comprising a layer comprised of a polymer and a fluoroalkyl ester; thereover a supporting substrate, a photogenerating layer, and at least one charge transport layer.

U.S. application Ser. No. 11/728,013, filed Mar. 23, 2007 by Jin Wu et al. on Photoconductor Fluorinated Charge Transport Layers, discloses a photoconductor comprising an optional supporting substrate, a photogenerating layer, and at least one fluoroalkyl ester containing charge transport layer.

U.S. application Ser. No. 11/728,007, filed Mar. 23, 2007 by Jin Wu et al. on Overcoated Photoconductors Containing Fluorinated Components, discloses a photoconductor comprising an optional supporting substrate, a photogenerating layer, at least one charge transport layer, and an overcoating layer in contact with and contiguous to the charge transport layer, and which overcoating is comprised of a fluoroalkyl ester, and a polymer.

U.S. application Ser. No. 11/961,549, filed Dec. 20, 2007 by Jin Wu et al. on Photoconductors Containing Ketal Overcoats, discloses a photoconductor comprising a supporting substrate, a photogenerating layer, and at least one charge transport layer comprised of at least one charge transport component, and an overcoat layer in contact with and contiguous to the charge transport layer, and which overcoat is comprised of a crosslinked polymeric network, an overcoat charge transport component, and at least one ketal.

A number of the components and amounts thereof of the above copending applications, such as the supporting substrates, resin binders, photogenerating layer components, antioxidants, charge transport components, hole blocking layer components, adhesive layers, a number of the overcoating layer components, and the like, may be selected for the members of the present disclosure in embodiments thereof.

BACKGROUND

This disclosure is generally directed to photoreceptors, photoconductors, and the like. More specifically, the present disclosure is directed to drum or rigid photoconductors, and multilayered flexible, belt imaging members, or devices comprised of an optional supporting medium like a substrate, a photogenerating layer, a charge transport layer, including a plurality of charge transport layers, such as a first charge transport layer and a second charge transport layer, an optional adhesive layer, an optional hole blocking or undercoat layer, and an overcoating layer comprised of a self crosslinking acrylic resin. In embodiments, the overcoating is comprised of a self crosslinking acrylic resin, a charge transport component, a catalyst, and a low surface energy component. At least one in embodiments refers, for example, to one, to from 1 to about 10, to from 2 to about 7; to from 2 to about 4, to 2, and the like.

The photoconductors illustrated herein, in embodiments, are solvent resistant, have excellent wear resistance, increased lifetimes, elimination or minimization of imaging member scratches, and which scratches can result in undesirable print failures where, for example, the scratches are visible on the final prints generated. Additionally, in embodiments the imaging members disclosed herein possess excellent, and in a number of instances low $V_r$ (residual potential); low acceptable image ghosting characteristics; low background and/or minimal charge deficient spots (CDS); and desirable toner cleanability.

Also included within the scope of the present disclosure are methods of imaging and printing with the photoresponsive or photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present disclosure in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, and processes of the above recited patents may be selected for the present disclosure in embodiments thereof.

SUMMARY

Disclosed are imaging members with many of the advantages illustrated herein, such as extended lifetimes of service of, for example, in excess of about 1,500,000 xerographic imaging cycles; excellent electronic characteristics; stable electrical properties; low image ghosting; low background and/or minimal charge deficient spots (CDS); resistance to charge transport layer cracking upon exposure to the vapor of certain solvents; excellent surface characteristics; improved wear resistance; compatibility with a number of toner compositions; the avoidance of or minimal imaging member scratching characteristics; improved, such as a lower $V_r$ as compared to similar photoconductors containing an overcoating of an acrylic resin, a polyalkylene glycol, a catalyst, a crosslinking component and a charge transport component; consistent $V_r$ (residual potential) that is substantially flat or no change over a number of imaging cycles as illustrated by the generation of known PIDCs (Photo-induced Discharge Curve); minimum cycle up in residual potential, and the like.

Also disclosed are layered photoresponsive imaging members which are responsive to near infrared radiation of from about 700 to about 900 nanometers and also with sensitivity to visible light.

Additionally disclosed are rigid imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000 permitting, for example, a hole blocking layer with excellent efficient electron transport which usually results in a desirable photoconductor low residual potential $V_{low}$.

Also disclosed are layered rigid drum photoreceptors wherein there is permitted the prevention of $V_r$ cycle up, caused primarily by photoconductor aging, for numerous imaging cycles, and layered rigid belt photoreceptors, and where the resulting imaging members exhibit low background and/or minimal CDS; and the prevention of $V_r$ cycle up, caused primarily by photoconductor aging, for numerous imaging cycles.

EMBODIMENTS

Aspects of the present disclosure relate to a photoconductor comprising an optional supporting substrate, a photogenerating layer, and at least one charge transport layer, and wherein at least one charge transport layer contains at least one charge transport component; and an overcoating layer in contact with and contiguous to the charge transport layer, and which overcoating is comprised of a self crosslinked acrylic resin, a charge transport component, and a low surface energy additive; a rigid photoconductor comprised in sequence of a substrate, a photogenerating layer, a charge transport layer, and an overcoating layer in contact with and contiguous to the charge transport layer, and which overcoating layer is comprised of a self crosslinked acrylic resin, a charge transport component, and an additive; a photoconductor comprising a supporting substrate, a photogenerating layer, and a charge transport layer comprised of at least one charge transport component and a resin binder, and wherein the transport layer component is comprised of hole transport molecules, and in contact with the charge transport layer a layer comprised of a self crosslinked acrylic polymer, a charge transport component, and a low surface energy additive, and wherein said overcoating layer is of a thickness of from about 0.5 to about 20 microns; a rigid photoconductor comprised in sequence of a substrate, a photogenerating layer, and at least one charge transport layer comprised of at least one charge transport component, and wherein the at least one charge transport layer is comprised of hole transport molecules and a resin binder, and an overcoating layer in contact with and contiguous to the top charge transport layer, and which overcoating layer is comprised of a self crosslinking acrylic resin, that is for example, a crosslinking component is not needed, a low surface energy component, a charge transport component, and a catalyst, and which overcoating can be formed by the reaction of the self crosslinking resin, and a charge transport compound in the presence of a catalyst resulting in a polymeric network primarily containing crosslinked acrylic resin, and the charge transport compound, and wherein the overcoating charge transport component is

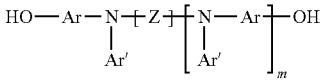

wherein m is zero or 1; Z is selected from the group consisting of at least one of

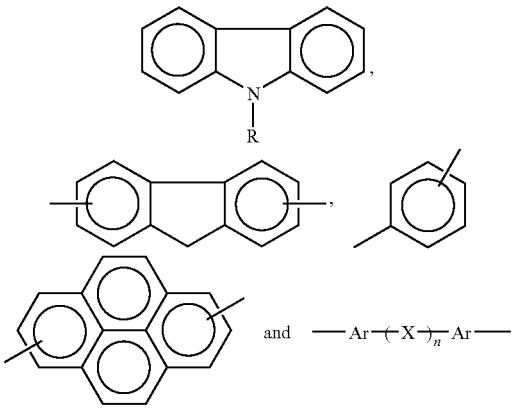

wherein n is 0 or 1; Ar is selected from the group consisting of at least one of

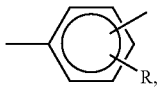

-continued

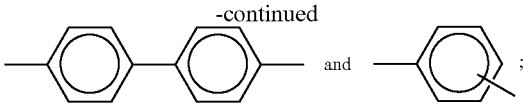

wherein R is selected from the group consisting of at least one of $—CH_3$, $—C_2H_5$, $—C_3H_7$, and $C_4H_9$; and Ar' is selected from the group consisting of at least one of

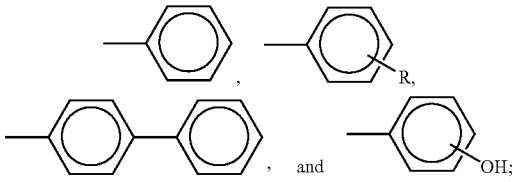

and X is selected from the group consisting of at least one of

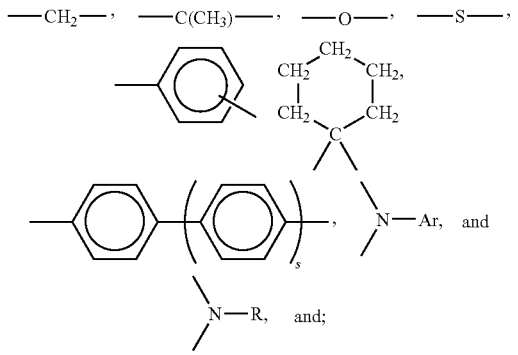

wherein S is zero, 1, or 2; a photoconductive member comprised of a substrate, a photogenerating layer thereover, at least one to about three charge transport layers thereover, a hole blocking layer, an adhesive layer, wherein in embodiments the adhesive layer is situated between the photogenerating layer and the hole blocking layer, and where the charge transport layer or layers contain known additives like antioxidants, and in contact with the entire surface of the charge transport layer a top overcoating protective layer as illustrated herein; a photoconductor wherein the low surface energy additive is at least one of hydroxyl derivatives of perfluoropolyoxyalkanes, hydroxyl derivatives of perfluoroalkanes, carboxylic acid derivatives of fluoropolyethers, carboxylic ester derivatives of perfluoroalkanes, sulfonic acid derivatives of perfluoroalkanes, ethoxysilane derivatives of fluoropolyethers, hydroxyl derivatives of silicone modified polyacrylates, polyether modified acryl polydimethylsiloxanes, and polyether modified hydroxyl polydimethylsiloxanes, or mixtures thereof; and a photoconductor wherein the low surface energy additive is a hydroxyl derivative of silicone modified polyacrylates, or a hydroxyl derivative of perfluoroalkane, and which component is present in an amount of from about 0.8 to about 4 weight percent.

The photoconductors disclosed herein include a protective overcoating layer (POC) usually in contact with and contiguous to the charge transport layer. This POC layer is comprised of components that include a self crosslinking acrylic resin, at least one transport compound, a catalyst residue, and a low surface energy component all reacted into a polymeric network. While the percentage of crosslinking can be difficult to determine and not being desired to be limited by theory, the overcoating layer is crosslinked to a suitable value, such as for example, from about 30 to about 100 percent, and from about 50 to about 95 percent.

The photoconductor overcoating layer can be applied by a number of different processes inclusive of dispersing the overcoat composition in a solvent system, and applying the resulting overcoat coating solution onto the receiving surface, for example, the top charge transport layer of the photoreceptor, to a thickness of, for example, from about 0.5 micron to about 20 microns, or from 0.5 micron to about 10 microns.

A blocking agent can also be included in the overcoat layer, which agent can "tie up" or substantially block the acid catalyst effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine and commercial acid solutions containing blocking agents such as CYCAT® 4045, available from Cytec Industries Inc.

The reaction temperature varies with the specific catalyst, the catalyst amount, and heating time utilized. Generally, the degree of crosslinking depends upon the desired flexibility of the final photoreceptor. For example, complete crosslinking, that is 100 percent, may be used for rigid drum or plate photoreceptors. However, partial crosslinking, for example from about 20 percent to about 80 percent, is usually selected for flexible photoreceptors having, for example, web or belt configurations. A typical concentration of acid catalyst is from about 0.01 to about 5 weight percent based on the weight of the self crosslinking acrylic resin.

The overcoating layer can also include a charge transport material to, for example, improve the charge transport mobility of the overcoating layer. According to various embodiments, the charge transport material for the charge transport layer or overcoating layer can be selected from the group consisting of at least one of (i) a phenolic substituted aromatic amine, (ii) a primary alcohol substituted aromatic amine, and (iii) mixtures thereof. In embodiments, the charge transport material can be a terphenyl of, for example, an alcohol soluble dihydroxy terphenyl diamine; an alcohol soluble dihydroxy TPD, and the like. An example of a terphenyl charge transporting molecule can be represented by the following formula

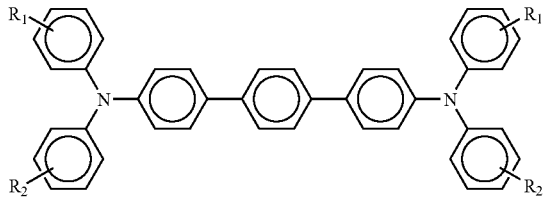

where each $R_1$ is —OH; and $R_2$ is alkyl ($C_nH_{2n+1}$) where, for example, n is from 1 to about 10, from 1 to about 5, or from about 1 to about 6; and aralkyl and aryl groups with, for example, from about 6 to about 30, or about 6 to about 20 carbon atoms. Suitable examples of aralkyl groups include, for example, $C_nH_{2n+1}$-phenyl groups where n is, for example, from about 1 to about 10, or from about 1 to about 5. Suitable examples of aryl groups include, for example, phenyl, naphthyl, biphenyl, and the like. In one embodiment, each $R_1$ is —OH to provide a dihydroxy terphenyl diamine hole transporting molecule. For example, where each $R_1$ is —OH and each $R_2$ is —H, the resultant compound is N,N'-diphenyl-N,N'-di[3-hydroxyphenyl]-terphenyl-diamine. In another embodiment, each $R_1$ is —OH, and each $R_2$ is independently an alkyl, aralkyl, or aryl group as defined above. In various embodiments, the charge transport material is soluble in the selected solvent used in forming the overcoating layer.

Non-limiting examples of catalysts include oxalic acid, maleic acid, carboxylic acid, ascorbic acid, malonic acid, succinic acid, tartaric acid, citric acid, p-toluenesulfonic acid, methanesulfonic acid, and the like, and mixtures thereof.

Examples of the self crosslinking resin include a self crosslinking acrylic resin with an average molecular weight ($M_w$) of from about 100,000 to about 500,000, or from about 120,000 to about 200,000; a polydispersity index (PDI) ($M_w/M_n$) of from about 1.5 to about 4, or from about 2 to about 3; and a bulk resistivity (20° C. and 50 percent humidity) of from about $10^8$ to about $10^{14}$ Ωcm, or from about $10^9$ to about $10^{12}$ Ωcm.

A specific example of the self crosslinking acrylic resin includes DORESCO® TA22-8 obtained from Lubrizol Dock Resins, Linden, N.J., which resin possesses, it is believed, a weight average molecular weight of about 160,000, a polydispersity index of about 2.3, and a bulk resistivity (20° C. and 50 percent humidity) of about $10^{11}$ Ωcm.

Additionally, included in the overcoating layer are low surface energy components, such as hydroxyl terminated fluorinated additives, hydroxyl silicone modified polyacrylates, and mixtures thereof. Examples of the low surface energy components, present in various effective amounts, such as from about 0.1 to about 25, from about 0.5 to about 15, and from about 1 to about 10 weight percent, are hydroxyl derivatives of perfluoropolyoxyalkanes such as FLUOROLINK® D (M.W. of about 1,000 and fluorine content of about 62 percent), FLUOROLINK® D10-H (M.W. of about 700 and fluorine content of about 61 percent), and FLUOROLINK® D10 (M.W. of about 500 and fluorine content of about 60 percent) (functional group —$CH_2OH$); FLUOROLINK® E (M.W. of about 1,000 and fluorine content of about 58 percent) and FLUOROLINK® E10 (M.W. of about 500 and fluorine content of about 56 percent) (functional group —$CH_2(OCH_2CH_2)_nOH$); FLUOROLINK® T (M.W. of about 550 and fluorine content of about 58 percent), and FLUOROLINK® T10 (M.W. of about 330 and fluorine content of about 55 percent) (functional group —$CH_2OCH_2CH(OH)CH_2OH$); and hydroxyl derivatives of perfluoroalkanes ($R_fCH_2CH_2OH$, wherein $R_f$=$F(CF_2CF_2)_n$) such as ZONYL® BA (M.W. of about 460 and fluorine content of about 71 percent), ZONYL® BA-L (M.W. of about 440 and fluorine content of about 70 percent), ZONYL® BA-LD (M.W. of about 420 and fluorine content of about 70 percent), and ZONYL® BA-N (M.W. of about 530 and fluorine content of about 71 percent); carboxylic acid derivatives of fluoropolyethers such as FLUOROLINK® C (M.W. of about 1,000 and fluorine content of about 61 percent), carboxylic ester derivatives of fluoropolyethers such as FLUOROLINK® L (M.W. of about 1,000 and fluorine content of about 60 percent), FLUOROLINK® L10 (M.W. of about 500 and fluorine content of about 58 percent), carboxylic ester derivatives of perfluoroalkanes ($R_fCH_2CH_2O(C{=}O)R$, wherein $R_f$=$F(CF_2CF_2)_n$ and R is alkyl) such as ZONYL® TA-N (fluoroalkyl acrylate, R=$CH_2$=CH—, M.W. of about 570 and fluorine content of about 64 percent), ZONYL® TM (fluoroalkyl methacrylate, R=$CH_2$=$C(CH_3)$—, M.W. of about 530 and fluorine content of about 60 percent), ZONYL® FTS (fluoroalkyl stearate, R=$C_{17}H_{35}$—, M.W. of about 700 and fluorine content of about 47 percent), ZONYL® TBC (fluoroalkyl citrate, M.W. of about 1,560 and fluorine content of about 63 percent), sulfonic acid derivatives of perfluoroalkanes ($R_fCH_2CH_2SO_3H$, wherein $R_f$=$F(CF_2CF_2)_n$) such as ZONYL® TBS (M.W. of about 530 and fluorine content of about 62 percent); ethoxysilane derivatives of fluoropolyethers such as FLUOROLINK® S10 (M.W. of about 1,750 to about 1,950); phosphate derivatives of fluoropolyethers such as FLUOROLINK® F10 (M.W. of about 2,400 to about 3,100); hydroxyl derivatives of silicone modified polyacrylates such as BYK-SILCLEAN® 3700; polyether modified acryl polydimethylsiloxanes such as BYK-SILCLEAN® 3710; polyether modified hydroxyl polydimethylsiloxanes such as BYK-SILCLEAN® 3720. FLUOROLINKE® is a trademark of Ausimont, ZONYL® is a trademark of DuPont, and BYK-SILCLEAN® is a trademark of BYK.

Any suitable primary, secondary or tertiary alcohol solvent can be employed for the deposition of the film forming overcoating layer. Typical alcohol solvents include, but are not limited to, for example, methanol, ethanol, tert-butanol, sec-butanol, 2-propanol, 1-methoxy-2-propanol, and the like, and mixtures thereof. Other suitable co-solvents that can be selected for the forming of the overcoating layer coating solution such as, for example, tetrahydrofuran, monochlorobenzene, and mixtures thereof. These co-solvents can be used as diluents for the above alcohol solvents, or they can be omitted. However, in some embodiments, it may be of value to minimize or avoid the use of higher boiling alcohol solvents since they should be removed as they may interfere with efficient crosslinking.

In embodiments, the components, including the self crosslinkable polymer, charge transport material, acid catalyst, blocking agent, and low surface energy component, utilized for the overcoating solution are soluble or substantially soluble in the solvent or solvents selected for the overcoating layer.

The thickness of the overcoating layer, which can depend upon the abrasiveness of the charging (for example bias charging roll), cleaning (for example blade or web), development (for example brush), transfer (for example bias transfer roll), etc., in the system employed, is, for example, from about 1 or about 2 microns up to about 10 or about 15 microns, or more. In various embodiments, the thickness of the overcoating layer can be from about 0.5 to about 20, from 1 to about 15, from 3 to about 10 microns. Typical application techniques for applying the overcoating layer over the photoconductive layer can include spraying, dip coating, roll coating, wire wound rod coating, and the like. Drying of the deposited overcoating layer can be effected by any suitable conventional technique such as oven drying, infrared radiation drying, air drying, and the like. The dried overcoating layer of this disclosure should transport charges during imaging.

In the dried overcoating layer, the composition can include from about 40 to about 90 percent by weight of a film forming self crosslinking acrylic resin, and from about 60 to about 10 percent by weight of charge transport material. For example, in embodiments, the charge transport material can be incorporated into the overcoating layer in an amount of from about 20 to about 50 percent by weight. As desired, the overcoating layer can also include other materials, such as conductive fillers, abrasion resistant fillers, and the like, in any suitable and known amounts.

In embodiments thereof, there is disclosed a photoconductive imaging member comprised of a supporting substrate, a photogenerating layer thereover, a charge transport layer, and an overcoating polymer layer; a photoconductive member with a photogenerating layer of a thickness of from about 0.1 to about 10 microns, at least one transport layer each of a thickness of from about 5 to about 100 microns; a xerographic imaging apparatus containing a charging component, a development component, a transfer component, and a fixing component, and wherein the apparatus contains a photoconductive imaging member comprised of a supporting substrate, and thereover a layer comprised of a photogenerating pigment and a charge transport layer or layers, and thereover an overcoating layer, and where the transport layer is of a thickness of from about 10 to about 75 microns; a member wherein the photogenerating layer contains a photogenerating pigment present in an amount of from about 10 to about 95 weight percent; a member wherein the thickness of the photogenerating layer is from about 0.2 to about 4 microns; a member wherein the photogenerating layer contains an inactive polymer binder; a member wherein the binder is present in an amount of from about 30 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of known suitable polymers like polyesters, polyvinyl butyrals, polycarbonates, polystyrene-b-polyvinyl pyridine, polyvinyl chloride-co-vinyl acetate-co-maleic acid, and polyvinyl formals; an imaging member wherein the photogenerating pigment is a metal free phthalocyanine; an imaging member wherein each of the charge transport layers, especially a first and second layer, or a single charge transport layer, and the charge transport compound in the overcoating layer comprises

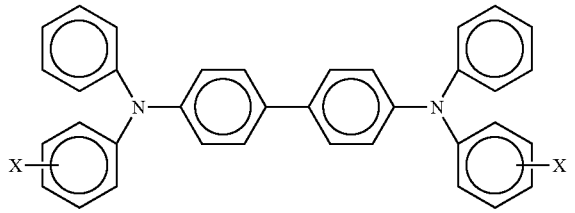

wherein X is selected from the group consisting of alkyl, alkoxy, and halogen, such as methyl and chloride; an imaging member wherein alkyl and alkoxy contain from about 1 to about 15 carbon atoms; an imaging member wherein alkyl contains from about 1 to about 5 carbon atoms; an imaging member wherein alkyl is methyl; an imaging member wherein each or at least one of the charge transport layers, especially a first and second charge transport layer, or a single charge transport layer, and the overcoating charge transport compound comprises

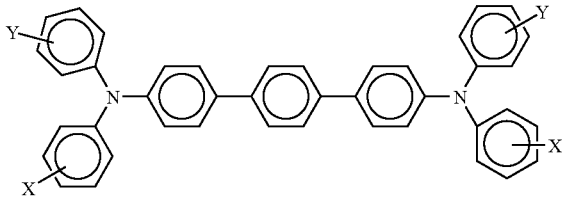

wherein X and Y are independently alkyl, alkoxy, aryl, a halogen, or mixtures thereof; an imaging member wherein, for example, alkyl and alkoxy contains from about 1 to about 15 carbon atoms; alkyl contains from about 1 to about 5 carbon atoms; and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing the ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging wherein the imaging member is exposed to light of a wavelength of from about 400 to about 950 nanometers; a member wherein the photogenerating layer is situated between the substrate and the charge transport; a member wherein the charge transport layer is situated between the substrate and the photogenerating layer, and wherein the number of charge transport layers is two; a member wherein the photogenerating layer is of a thickness of from about 0.2 to about 15 microns; a member wherein the photogenerating component amount is from about 0.05 weight percent to about 20 weight percent, and wherein the photogenerating pigment is dispersed in from about 10 weight percent to about 80 weight percent of a polymer binder; a member wherein the thickness of the photogenerating layer is from about 0.1 to about 11 microns; a member wherein the photogenerating and charge transport layer components are contained in a polymer binder; a member wherein the binder is present in an amount of from about 50 to about 90 percent by weight, and wherein the total of the layer components is about 100 percent; wherein the photogenerating resinous binder is selected from the group consisting of polyvinyl chloride-co-vinyl acetate-co-maleic acid, polyesters, polyvinyl butyrals, polycarbonates, polystyrene-b-polyvinyl pyridine, and polyvinyl formals; an imaging member wherein the photogenerating component is Type V hydroxygallium phthalocyanine, Type V titanyl phthalocyanine or chlorogallium phthalocyanine, and the charge transport layer and/or the overcoating layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; an imaging member further containing an adhesive layer and a hole blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a photogenerating layer, a hole transport layer, and a top overcoating layer in contact with the hole transport layer, or in embodiments in contact with the photogenerating layer, and in embodiments wherein a plurality of charge transport layers are selected, such as, for example, from 2 to about 10, and more specifically 2 may be selected; and a photoconductive imaging member comprised of an optional supporting substrate, a photogenerating layer, and a first, second, and third charge transport layer.

The thickness of the photoconductor substrate layer depends on many factors, including economical considerations, electrical characteristics, and the like, thus this layer may be of substantial thickness, for example over 3,000 microns, such as from about 1,000 to about 2,000 microns, from about 500 to about 900 microns, from about 300 to about 700 microns, or of a minimum thickness. In embodiments, the thickness of this layer is from about 75 microns to about 300 microns, or from about 100 microns to about 150 microns.

The substrate may be opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, as disclosed in a copending application referenced herein, this layer may be of substantial thickness of, for example, up to many centimeters or of a minimum thickness of less than a millimeter. Similarly, a flexible belt may be of a substantial thickness of, for example, about 250 micrometers, or of a minimum thickness of less than about 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example, polycarbonate materials commercially available as MAKROLON®.

The photogenerating layer in embodiments is comprised of a number of known photogenerating pigments, such as for example, about 50 weight percent of Type V hydroxygallium phthalocyanine or chlorogallium phthalocyanine, and about 50 weight percent of a resin binder like poly(vinyl chloride-co-vinyl acetate) copolymer, such as VMCH (available from Dow Chemical). Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis (benzimidazo)perylene, titanyl phthalocyanines, and the like, and more specifically, vanadyl phthalocyanines, Type V titanyl phthalocyanine, Type V hydroxygallium phthalocyanines, and inorganic components, such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations. The photogenerating layer binder resin is present in various suitable amounts, for example from about 1 to about 50 weight percent, and more specifically, from about 1 to about 10 weight percent, and which resin may be selected from a number of known polymers, such as poly(vinyl butyral), poly (vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, silanols, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like; hydrogenated amorphous silicon; and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments, such as quinacridones, polycyclic pigments, such as dibromo anthanthrone pigments, perylene and perinone diamines, polynuclear aromatic quinones, azo pigments including bis-, tris- and tetrakis-azos; and the like dispersed in a film forming polymeric binder, and fabricated by solvent coating techniques.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The photogenerating composition or pigment is present in the resinous binder composition in various amounts. Generally, however, from about 5 percent by weight to about 90 percent by weight of the photogenerating pigment is dispersed in about 10 percent by weight to about 95 percent by weight of the resinous binder, or from about 20 percent by weight to about 50 percent by weight of the photogenerating pigment is dispersed in about 80 percent by weight to about 50 percent by weight of the resinous binder composition. In one embodiment, about 50 percent by weight of the photogenerating pigment is dispersed in about 50 percent by weight of the resinous binder composition.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking, hole blocking layer or interfacial layer, and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 micron to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layer for the imaging members of the present disclosure can contain a number of components including known hole blocking components, such as amino silanes, doped metal oxides, a metal oxide like titanium, chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S; and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical); formaldehyde polymers with ammonia, cresol and phenol, such as VARCUM® 29112 (available from OxyChem Company); formaldehyde polymers with 4,4'-(1-methylethylidene) bisphenol, such as VARCUM® 29108 and 29116 (available from OxyChem Company); formaldehyde polymers with cresol and phenol, such as VARCUM® 29457 (available from OxyChem Company), DURITE® SD-423A, SD-422A (available from Borden Chemical); or formaldehyde polymers with phenol and p-tert-butylphenol, such as DURITE® ESD 556C (available from Borden Chemical).

The hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

The charge transport layer, which layer is generally of a thickness of from about 5 microns to about 75 microns, and more specifically, of a thickness of from about 10 microns to about 40 microns, components, and molecules include a number of known materials, such as aryl amines, of the following formula

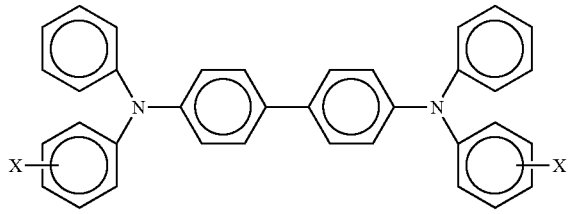

wherein X is alkyl, alkoxy, aryl, a halogen, or mixtures thereof, or wherein each X is present on each of the four terminating rings; and especially those substituents selected from the group consisting of Cl and $CH_3$; and molecules of the following formula

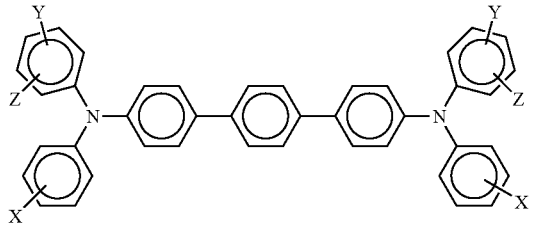

wherein at least one of X, Y and Z are independently alkyl, alkoxy, aryl, a halogen, or mixtures thereof, and wherein either Y or Z, or both Y and Z can be present; N,N'-diphenyl-N,N'-bis(3-hydroxyphenyl)-[1,1'-biphenyl]-4,4'-diamine (DHTBD) represented by

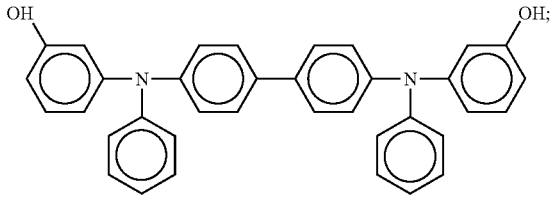

terphenyl arylamines as represented by

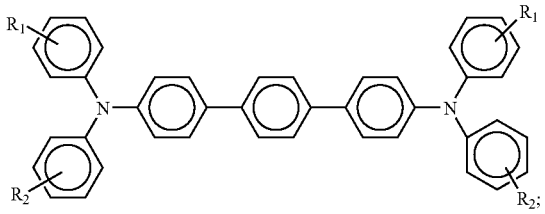

wherein each $R_1$ and $R_2$ is independently selected from the group consisting of at least one of —H, —OH, —$C_nH_{2n+1}$, where n is from 1 to about 12, aralkyl, and aryl groups, the aralkyl and aryl groups having, for example, from about 6 to about 36 carbon atoms. The dihydroxy arylamine compounds can be free of any direct conjugation between the —OH groups and the nearest nitrogen atom through one or more aromatic rings. The expression "direct conjugation" refers, for example, to the presence of a segment, having the formula —(C═C)$_n$—C═C— in one or more aromatic rings directly between an —OH group and the nearest nitrogen atom. Examples of direct conjugation between the —OH groups and the nearest nitrogen atom through one or more aromatic rings include a compound containing a phenylene group having an —OH group in the ortho or para position (or 2 or 4 position) on the phenylene group relative to a nitrogen atom attached to the phenylene group, or a compound containing a polyphenylene group having an —OH group in the ortho or para position on the terminal phenylene group relative to a nitrogen atom attached to an associated phenylene group. Examples of aralkyl groups include, for example, —$C_nH_{2n+1}$-phenyl groups where n is from about 1 to about 5, or from about 1 to about 10; examples of aryl groups include, for example, phenyl, naphthyl, biphenyl, and the like. In embodiments when $R_1$ is —OH and each $R_2$ is n-butyl, the resultant compound is N,N'-bis[4-n-butylphenyl]-N,N'-di[3-hydroxyphenyl]-terphenyl-diamine (DHTER). Also, in embodiments, the hole transport component is substantially soluble in the solvent selected for the formation of the overcoating layer.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

The charge transport layer component can also be selected as the charge transport compound for the photoconductor top overcoating layer.

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport layer may comprise charge transporting small molecules dissolved or molecularly dispersed in a film forming electrically inert polymer such as a polycarbonate. In embodiments, "dissolved" refers, for example, to forming a solution in which the small molecule and silanol are dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of charge transporting molecules present in the charge transport layer in an amount of, for example, from about 20 to about 55 weight percent include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triaminotriphenyl methane. A small molecule charge transporting compound that permits injection of holes into the photogenerating layer with high efficiency, and transports them across the charge transport layer with short transit times, and which layer contains a binder and a silanol includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 5 to about 75 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and this thickness can be up to about 10 micrometers. In embodiments, this thickness for each layer is from about 1 micrometer to about 5 micrometers. Various suitable and conventional methods may be used to mix, and thereafter apply the overcoat layer coating mixture to the charge transport layer. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration.

The top charge transport layer can comprise the same components as the charge transport layer wherein the weight ratio between the charge transporting small molecules, and the suitable electrically inactive resin binder is less, such as for example, from about 0/100 to about 60/40, or from about 20/80 to about 40/60, and more specifically, wherein the molecules can be represented by

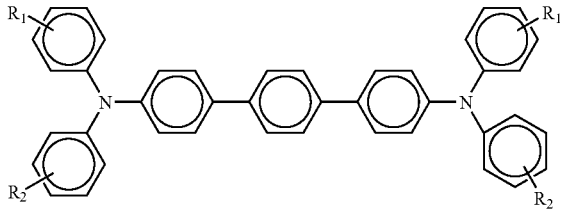

wherein each $R_1$ is —OH; and $R_2$ is alkyl (—$C_nH_{2n+1}$), where, for example, n is from 1 to about 10, from 1 to about 5, or from about 1 to about 6; and aralkyl and aryl groups with, for example, from about 6 to about 30, or about 6 to about 20 carbon atoms. Suitable examples of aralkyl groups include, for example, —$C_nH_{2n+1}$-phenyl groups where n is, for example, from about 1 to about 5 or from about 1 to about 10. Suitable examples of aryl groups include, for example, phenyl, naphthyl, biphenyl, and the like. In one embodiment, each $R_1$ is —OH to provide a dihydroxy terphenyl diamine hole transporting molecule. For example, where each $R_1$ is —OH and each $R_2$ is —H, the resultant compound is N,N'-diphenyl-N,N'-di[3-hydroxyphenyl]-terphenyl-diamine. In another embodiment, each $R_1$ is —OH, and each $R_2$ is independently an alkyl, aralkyl, or aryl group as defined above. In various embodiments, the charge transport material is soluble in the selected solvent used in forming the overcoating layer.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents, and each of the components/compounds/molecules, polymers (components) for each of the layers specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed, claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. Similarly, the thickness of each of the layers, the examples of components in each of the layers, the amount ranges of each of the components disclosed and claimed are not exhaustive, and it is intended that the present disclosure and claims encompass other suitable parameters not disclosed, or that may be envisioned.

The following Examples are provided.

COMPARATIVE EXAMPLE 1

The three component hole blocking or undercoat layer was prepared as follows. Zirconium acetylacetonate tributoxide (35.5 parts), γ-aminopropyl triethoxysilane (4.8 parts) and poly(vinyl butyral) BM-S (2.5 parts) were dissolved in n-butanol (52.2 parts). The coating solution was coated via a dip coater, and the layer was pre-heated at 59° C. for 13 minutes, humidified at 58° C. (dew point=54° C.) for 17 minutes, and dried at 135° C. for 8 minutes. The thickness of the undercoat layer was approximately 1.3 microns.

A photogenerating layer at a thickness of about 0.2 micron comprising hydroxygallium phthalocyanine Type V was disposed on the above hole blocking layer or undercoat layer at a thickness of about 1.3 microns. The photogenerating layer coating dispersion was prepared as follows. 3 Grams of the Type V pigment were mixed with 2 grams of polymeric binder (carboxyl-modified vinyl copolymer, VMCH, Dow Chemical Company), and 45 grams of n-butyl acetate. The mixture was milled in an Attritor mill with about 200 grams of 1 millimeter Hi-Bea borosilicate glass beads for about 3 hours. The dispersion was filtered through a 20 micron Nylon cloth filter, and the solid content of the dispersion was diluted to about 6 weight percent.

Subsequently, a 26 micron thick charge transport layer was coated on top of the photogenerating layer from a solution prepared from N,N'-diphenyl-N,N-bis(3-methylphenyl)-1,1'-biphenyl-4,4'-diamine (5 grams), a film forming polymer binder PCZ 400 [poly(4,4'-dihydroxy-diphenyl-1-1-cyclohexane, $M_w$=40,000)] available from Mitsubishi Gas Chemical Company, Ltd. (7.5 grams) in a solvent mixture of 30 grams of tetrahydrofuran (THF), and 10 grams of monochlorobenzene (MCB) via simple mixing. The charge transport layer was dried at about 135° C. for about 40 minutes.

COMPARATIVE EXAMPLE 2

A photoconductor was prepared by repeating the above process of Comparative Example 1 except that an overcoating layer was applied to the charge transport layer. The overcoating solution was formed by adding 0.5 gram of JONCRYL® 587 (an acrylated polyol obtained from Johnson Polymers), 0.7 gram of CYMEL® 303 (a methylated, butylated melamine-formaldehyde crosslinking agent obtained from Cytec Industries Inc.), 0.6 gram of N,N'-diphenyl-N,N'-bis(3-hydroxyphenyl)-[1,1'-biphenyl]-4,4'-diamine (DHTBD), 0.072 gram of BYK-SILCLEAN® 3700 (a hydroxylated silicone modified polyacrylate obtained from BYK-Chemie USA), and 0.09 gram of NACURE® XP357 (a blocked acid catalyst obtained from King Industries) in 7.2 grams of DOWANOL® PM (1-methoxy-2-propanol obtained from the Dow Chemical Company).

The photoconductor, and more specifically the charge transport layer of Comparative Example I, was then overcoated with the above prepared overcoating solution using a ring coater. The resultant overcoating layer was dried in a forced air oven for 40 minutes at 140° C. to yield a highly crosslinked, 3 micron thick overcoating layer, and which overcoating layer was substantially insoluble in methanol or ethanol.

EXAMPLE I

A photoconductor was prepared by repeating the process of Comparative Example 2 except that the overcoating solution was comprised of a self crosslinking acrylic resin in place of both the acrylic polyol resin and the crosslinking agent of Comparative Example 2; and the charge transport component, the catalyst, and a low surface energy additive, and which overcoating layer was substantially insoluble in methanol or ethanol after drying.

More specifically, the overcoating layer was prepared as follows. 4.67 Grams of DORESCO® TA22-8 (a self crosslinking acrylic resin obtained from Lubrizol Dock Resins, about 30 weight percent in ethanol/acetone), 0.6 gram of N,N'-diphenyl-N,N'-bis(3-hydroxyphenyl)-[1,1'-biphenyl]-4,4'-diamine (DHTBD), 0.072 gram of BYK-SILCLEAN® 3700 (a hydroxylated silicone modified polyacrylate obtained from BYK-Chemie USA), and 0.09 gram of NACURE® XP357 (a blocked acid catalyst obtained from King Industries) in 4 grams of DOWANOL® PM (1-methoxy-2-propanol obtained from the Dow Chemical Company). The resultant overcoating layer was dried in a forced air oven for 40 minutes at 140° C. to yield a highly crosslinked, 3 micron thick overcoating layer.

EXAMPLE II

A photoconductor was prepared by repeating the process of Comparative Example 2 except that the overcoating solution was comprised of a self crosslinking acrylic resin in place of both the acrylic polyol resin and the crosslinking agent of Comparative Example 2; and the charge transport component, the catalyst and a low surface energy additive, and which overcoating layer was substantially insoluble in methanol or ethanol after drying.

More specifically, the overcoating layer was prepared as follows. 4 Grams of DORESCO® TA22-8 (a self crosslinking acrylic resin obtained from Lubrizol Dock Resins, about 30 weight percent in ethanol/acetone), 0.8 gram of N,N'-diphenyl-N,N'-bis(3-hydroxyphenyl)-[1,1'-biphenyl]-4,4'-diamine (DHTBD), 0.072 gram of BYK-SILCLEAN® 3700 (a hydroxylated silicone modified polyacrylate obtained from BYK-Chemie USA), and 0.09 gram of NACURE® XP357 (a blocked acid catalyst obtained from King Industries) in 4 grams of DOWANOL® PM (1-methoxy-2-propanol obtained from the Dow Chemical Company). The resultant overcoating layer was dried in a forced air oven for 40 minutes at 140° C. to yield a highly crosslinked, 3 micron thick overcoating layer.

EXAMPLE III

A photoconductor was prepared by repeating the process of Comparative Example 2 except that the overcoating solution was comprised of a self crosslinking acrylic resin in place of both the acrylic polyol resin and the crosslinking agent of Comparative Example 2; and the charge transport component, the catalyst and a low surface energy additive, and which overcoating layer was substantially insoluble in methanol or ethanol after drying.

More specifically, the overcoating layer was prepared as follows. 3.33 Grams of DORESCO® TA22-8 (a self crosslinking acrylic resin obtained from Lubrizol Dock Resins, about 30 weight percent in ethanol/acetone), 1 gram of N,N'-diphenyl-N,N'-bis(3-hydroxyphenyl)-[1,1'-biphenyl]-4,4'-diamine (DHTBD), 0.072 gram of BYK-SILCLEAN® 3700 (a hydroxylated silicone modified polyacrylate obtained from BYK-Chemie USA), and 0.09 gram of NACURE® XP357 (a blocked acid catalyst obtained from King Industries) in 4 grams of DOWANOL® PM (1-methoxy-2-propanol obtained from the Dow Chemical Company). The resultant overcoating layer was dried in a forced air oven for 40 minutes at 140° C. to yield a highly crosslinked, 3 micron thick overcoating layer.

EXAMPLE IV

A photoconductor is prepared by repeating the process of Comparative Example 2 except that the overcoating solution is comprised of a self crosslinking acrylic resin in place of both the acrylic polyol resin and the crosslinking agent of Comparative Example 2; and N,N'-diphenyl-N,N'-di[3-hydroxyphenyl]-terphenyl-diamine (DHTER) in place of N,N'-diphenyl-N,N'-bis(3-hydroxyphenyl)-[1,1'-biphenyl]-4,4'-diamine (DHTBD) of Comparative Example 2, the catalyst and the low surface energy additive of Comparative Example 2, and which overcoating layer is substantially insoluble in methanol or ethanol after drying.

More specifically, the overcoating layer is prepared as follows. 4 Grams of DORESCO® TA22-8 (a self crosslinking acrylic resin obtained from Lubrizol Dock Resins, about 30 weight percent in ethanol/acetone), 0.8 gram of N,N'-diphenyl-N,N'-di[3-hydroxyphenyl]-terphenyl-diamine (DHTER), 0.072 gram of BYK-SILCLEAN® 3700 (a hydroxylated silicone modified polyacrylate obtained from BYK-Chemie USA), and 0.09 gram of NACURE® XP357 (a blocked acid catalyst obtained from King Industries) in 4 grams of DOWANOL® PM (1-methoxy-2-propanol obtained from the Dow Chemical Company). The resultant overcoating layer is dried in a forced air oven for 40 minutes at 140° C. to yield a highly crosslinked, 3 micron thick overcoating layer.

Electrical Property Testing

The above prepared photoconductor devices of Comparative Examples 1 and 2, and Examples I, II and III were tested in a scanner set to obtain photoinduced discharge cycles, sequenced at one charge-erase cycle, followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of −700 volts with the exposure light intensity incrementally increased by means of a data acquisition system where the current to the light emitting diode was controlled to obtain different exposure levels. The exposure light source was a 780 nanometer light emitting diode. The xerographic simulation process was completed in an environmentally controlled light tight chamber at ambient conditions (40 percent relative humidity and 22° C.). The results are summarized in Table 1.

TABLE 1

| | V (2.8 ergs/cm$^2$) (V) | V (6.0 ergs/cm$^2$) (V) |
|---|---|---|
| Comparative Example 1 | 113 | 54 |
| Comparative Example 2 | 196 | 148 |
| Example I | 148 | 97 |
| Example II | 126 | 70 |
| Example III | 120 | 59 |

In embodiments, there are disclosed a number of improved characteristics for the photoconductors of Examples I, II and III as determined by the generation of known PIDC curves, such as significantly faster transport. More specifically, V (2.8 ergs/cm$^2$) and V (6.0 ergs/cm$^2$) in Table 1 represent the surface potential of the photoconductor devices, respectively, when exposure is 3.5 ergs/cm$^2$ and 6.0 ergs/cm$^2$, and are used to characterize the PIDC.

It is known that charge transport is dependent on the charge transport component loading, higher the charge transport component loading, faster the transport when the polymeric binder is the same; or when the charge transport component loading is the same; charge transport is dependent on the bulk resistivity of the polymeric binder, lower the bulk resistivity, faster the transport.

The disclosed self crosslinking acrylic resin of Examples I, II and III possesses a bulk resistivity (20° C. and 50 percent humidity) of about $10^{11}$ Ωcm. In contrast, the controlled acrylic polyol resin and crosslinking agent of Comparative Example 2 possesses a bulk resistivity (20° C. and 50 percent humidity) of about $10^{14}$ Ωcm; and the polycarbonate resin of Comparative Example 1 possesses a bulk resistivity (20° C. and 50 percent humidity) of about $10^{16}$ Ωcm. The bulk resistivity measurement was made using a Keithley model 237 High Voltage Source Measuring Unit at ambient conditions (20° C. and 50 percent humidity). The samples were electroded with a gold dot on the surface and the ground plane exposed on the bottom for both probe contacts. Voltage was swept from about 10V to 1,200V, and current was measured for each sample. Bulk resistivity was then calculated. Two to three repeating processes were performed on each sample and averaged for the final result.

The same charge transport component (DHTBD) was used in the overcoating layers of Comparative Example 2 and Examples I, II and III. About a 50V reduction of both V (2.8 ergs/cm$^2$) and V (6.0 ergs/cm$^2$) was observed for the photoconductor of Example I (the disclosed self crosslinking acrylic resin with 30 percent of DHTBD) as compared to that of Comparative Example 2 (the acrylate polyol and crosslinking agent with 33 percent of DHTBD), see Table 1. Thus more rapid transport was realized with the disclosed more conductive self crosslinking acrylic resin in the overcoating layer.

With increasing loading of the charge transport component (40 percent of DHTBD see Example II and 50 percent of DHTBD see Example III), both V (2.8 ergs/cm$^2$) and V (6.0 ergs/cm$^2$) were further reduced so that the overcoating layer was almost invisible from the PIDC point of view for Example III when compared with Comparative Example 1 (without any overcoating layer), which exhibited comparable V (2.8 ergs/cm$^2$) and V (6.0 ergs/cm$^2$) characteristics.

Cyclic Stability Testing

The above-prepared photoconductor of Example I was tested for cyclic stability by using an in-house high-speed Hyper Mode Test (HMT) at warm and humid conditions (80 percent relative humidity and 80° F.). The HMT fixture rotated the drum photoconductors at 150 rpm under a scorotron set to −700 volts then exposed the drum with a LED erase lamp. Two voltage probes were positioned 90 degrees apart to measure $V_{high}$ ($V_H$) and $V_{residual}$ ($V_L$) with nonstop 1 million charge/discharge/erase cycling numbers. The ozone that was produced during cycling was evacuated out of the chamber by means of an air pump and ozone filter.

The HMT cycling results are shown in Table 2.

TABLE 2

| HMT Cycles | | 100 | 200,000 | 400,000 | 600,000 | 1,000,000 |
|---|---|---|---|---|---|---|
| Comparative Example 1 | $V_H$ (V) | 677 | 675 | 670 | 671 | 670 |
| Example I | $V_L$ (V) | 21 | 15 | 20 | 27 | 40 |

After a continuous 1 million cycles, $V_H$ for the disclosed photoconductor Example I remained almost unchanged. $V_L$ cycle up for the disclosed photoconductor Example I was only about 20 volts. The disclosed photoconductor possesses superb cyclic stability.

Wear Testing

Wear tests of the above three photoconductors (Comparative Examples 1 and 2, and Example II) were performed using a FX440 (Fuji Xerox) wear fixture. The total thickness of each photoconductor device was measured via Permascope before each wear test was initiated. Then the photoconductor devices were separately placed into the wear fixture for 50 kilocycles. The total thickness was measured again, and the difference in thickness was used to calculate wear rate (nanometer/kilocycle) of the photoconductors. The smaller the wear rate, the more wear resistant the photoconductor. The wear rate data are summarized in Table 3.

TABLE 3

| Photoconductor | Wear Rate (Nanometer/kilocycle) |
|---|---|
| Comparative Example 1 | 95 |
| Comparative Example 2 | 20 |
| Example II | 30 |

The wear rate for the disclosed photoconductor (Example II with 40 percent of DHTBD in the overcoating layer) was only one third of that for the comparative photoconductor without any overcoating layer (Comparative Example 1). The addition of the disclosed overcoating layer significantly extended the photoconductor life. Furthermore, comparable wear rate was observed for the disclosed overcoating layer (Example II with 40 percent of DHTBD in the overcoating layer) as compared to the Comparative Example 2 with 33 percent of DHTBD in the overcoating layer).

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising an optional supporting substrate, a photogenerating layer, and at least one charge transport layer, and wherein at least one charge transport layer contains at least one charge transport component; and an overcoating layer in contact with and contiguous to said charge transport layer, and which overcoating is comprised of a self crosslinked acrylic resin possesses a bulk resistivity (20° C. and 50 percent humidity) of from about $10^8$ to about $10^{14}$ Ωcm, a charge transport component, and a low surface energy additives components such as hydroxyl terminated fluorinated.

2. A photoconductor in accordance with claim 1 wherein said supporting substrate is present, and said overcoating layer further contains a catalyst residue.

3. A photoconductor in accordance with claim 1 wherein said resin, said additive, and said charge transport component are reacted in the presence of an acid catalyst to form a crosslinked polymeric network.

4. A photoconductor in accordance with claim 1 wherein the self crosslinked acrylic resin possesses a bulk resistivity (20° C. and 50 percent humidity) of from about $10^9$ to about $10^{12}$ Ωcm.

5. A photoconductor in accordance with claim 1 wherein the self crosslinked acrylic resin possesses an average molecular weight ($M_w$) of from about 100,000 to about 500,000, and a polydispersity index (PDI) ($M_w/M_n$) of from about 1.5 to about 4.

6. A photoconductor in accordance with claim 1 wherein the self crosslinked acrylic resin possesses an average molecular weight ($M_w$) of from about 120,000 to about 200,000, and a polydispersity index (PDI) ($M_w/M_n$) of from about 2 to about 3.

7. A photoconductor in accordance with claim 1 wherein the overcoating charge transport component is selected from the group consisting of at least one of (i) a phenolic substituted aromatic amine, and (ii) a primary alcohol substituted aromatic amine.

8. A photoconductor in accordance with claim 1 wherein the overcoating charge transport component is

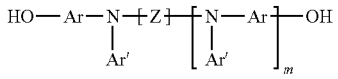

wherein m is zero or 1; Z is selected from the group consisting of at least one of

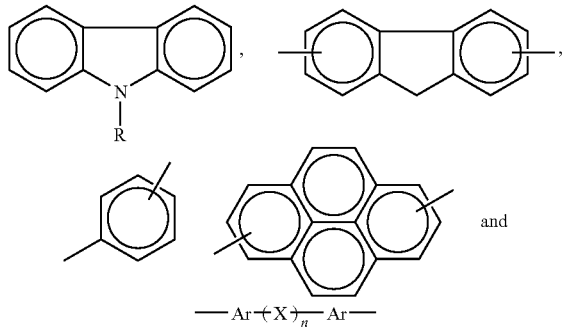

wherein n is 0 or 1; Ar is selected from the group consisting of at least one of

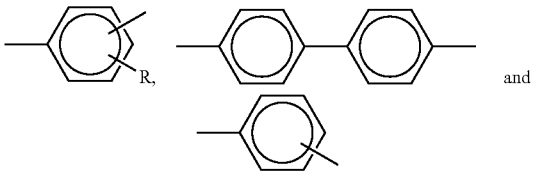

wherein R is selected from the group consisting of at least one of —$CH_3$, —$C_2H_5$, —$C_3H_7$, and $C_4H_9$, and Ar' is selected from the group consisting of at least one of

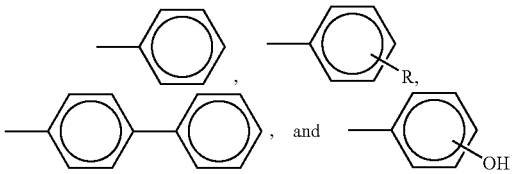

and X is selected from the group consisting of at least one of

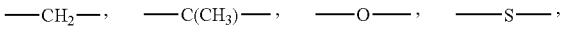

-continued

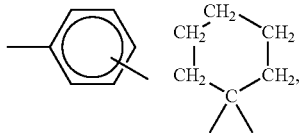

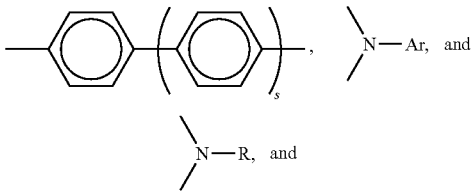

wherein S is zero, 1, or 2.

9. A photoconductor in accordance with claim 1 wherein the low surface energy additives is at least one of hydroxyl derivatives of perfluoropolyoxyalkanes, hydroxyl derivatives of perfluoroalkanes, carboxylic acid derivatives of fluoropolyethers, carboxylic ester derivatives of perfluoroalkanes, sulfonic acid derivatives of perfluoroalkanes, alkoxysilane derivatives of fluoropolyethers, hydroxyl derivatives of silicone modified polyacrylates, polyether modified acryl polydimethylsiloxanes, and polyether modified hydroxyl polydimethylsiloxanes.

10. A photoconductor in accordance with claim 1 wherein said low surface energy additive is present in an amount of from about 0.1 to about 20 weight percent.

11. A photoconductor in accordance with claim 1 wherein said low surface energy additive is present in an amount of from about 0.5 to about 5 weight percent.

12. A photoconductor in accordance with claim 9 wherein said low surface energy additive is a hydroxyl derivative of a silicone modified polyacrylate, or a hydroxyl derivative of perfluoroalkane, and which component is present in an amount of from about 0.8 to about 4 weight percent.

13. A photoconductor in accordance with claim 1 wherein said charge transport layer is comprised of aryl amine molecules, and which aryl amines are of the formula

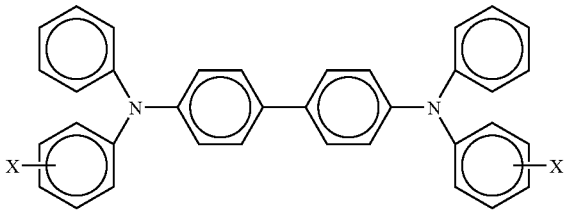

wherein X is selected from the group consisting of at least one of alkyl, alkoxy, aryl, and halogen.

14. A photoconductor in accordance with claim 1 wherein said charge transport layer is comprised of aryl amine molecules, and which aryl amines are of the formula

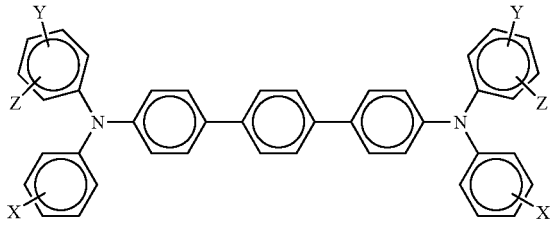

wherein each X, Y and Z is independently selected from the group consisting of at least one alkyl, alkoxy, aryl, halogen, and mixtures thereof.

15. A photoconductor in accordance with claim 14 wherein said aryl amine is selected from the group consisting of at least one of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine.

16. A photoconductor in accordance with claim 1 wherein said at least one charge transport layer is from 1 to about 3 layers.

17. A photoconductor in accordance with claim 1 wherein said at least one charge transport layer is comprised of a top charge transport layer and a bottom charge transport layer, and wherein said bottom layer is situated between said photogenerating layer and said top charge transport layer.

18. A photoconductor in accordance with claim 1 wherein said catalyst is at least one of oxalic acid, maleic acid, carbolic acid, ascorbic acid, malonic acid, succinic acid, tartaric acid, citric acid, p-toluenesulfonic acid, and methanesulfonic acid.

19. A photoconductor in accordance with claim 1 wherein said photogenerating layer is comprised of at least one of a metal free phthalocyanine, a titanyl phthalocyanine, a halogallium phthalocyanine, a perylene, or mixtures thereof.

20. A photoconductor in accordance with claim 19 wherein said photogenerating layer is comprised of a hydroxygallium phthalocyanine, a chlorogallium phthalocyanine pigment, or a titanyl phthalocyanine pigment.

21. A photoconductor in accordance with claim 1 wherein said acrylic resin possesses a bulk resistivity (20° C. and 50 percent humidity) of from about $10^9$ to about $10^{12}$ Ωcm; said charge transport layer contains at least one of

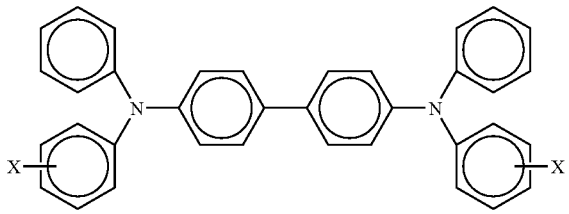

wherein X is selected from the group consisting of at least one of alkyl, alkoxy, aryl, and halogen, and

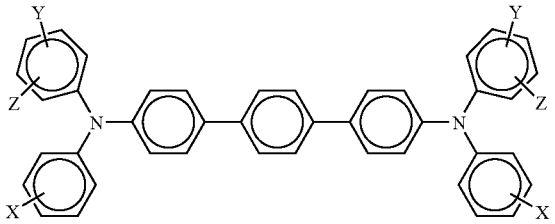

wherein each X, Y and Z is independently selected from the group consisting of at least one alkyl, alkoxy, aryl, and halogen, and mixtures thereof; said overcoating charge transport component is

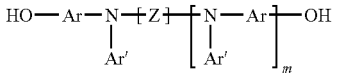

wherein m is zero or 1; Z is selected from the group consisting of at least one of

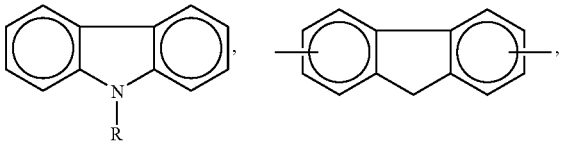

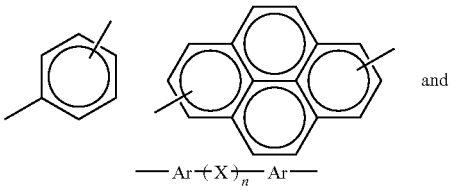

wherein n is 0 or 1; Ar is selected from the group consisting of at least one of

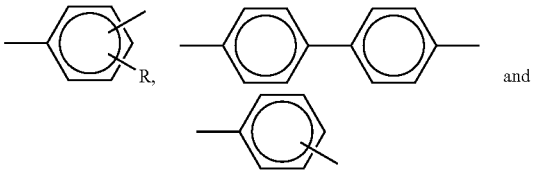

wherein R is selected from the group consisting of at least one of —$CH_3$, —$C_2H_5$, —$C_3H_7$, and $C_4H_9$, and Ar' is selected from the group consisting of at least one of

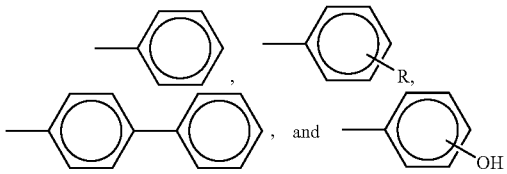

and X is selected from the group consisting of at least one of

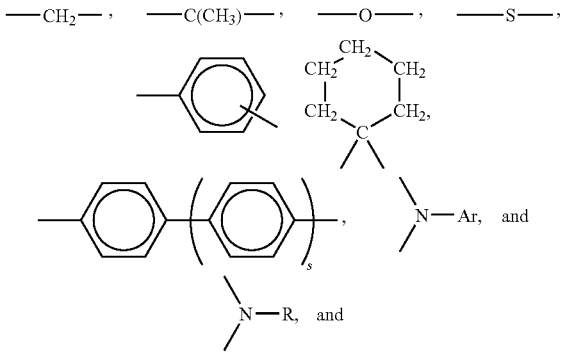

wherein S is zero, 1, or 2; and said additive is a hydroxyl derivative of silicone modified polyacrylate, a hydroxyl derivative of perfluoroalkane, or mixtures thereof.

22. A photoconductor comprising a supporting substrate, a photogenerating layer, and a charge transport layer comprised of at least one charge transport component and a resin binder, and wherein said transport layer component is comprised of hole transport molecules, and in contact with the charge transport layer a layer comprised of a self crosslinked acrylic polymer possesses a bulk resistivity (20° C. and 50 percent humidity) of from about $10^8$ to about $10^{14}$ Ωcm, a charge transport component, and a low surface energy additive, and wherein said overcoating layer is of a thickness of from about 0.5 to about 20 microns.

23. A photoconductor in accordance with claim 22 wherein said self crosslinking acrylic polymer is thermally cured.

24. A photoconductor in accordance with claim 1 wherein said additive is a hydroxyl derivative of a silicone modified polyacrylate, or a hydroxyl derivative of perfluoroalkane, and which component is present in an amount of from about 0.8 to about 4 weight percent.

* * * * *